US006728497B2

(12) United States Patent
Masuda et al.

(10) Patent No.: US 6,728,497 B2
(45) Date of Patent: Apr. 27, 2004

(54) IMAGE FORMING APPARATUS HAVING A HEATING MEMBER TO HEAT THE RECORDING MEDIUM

(75) Inventors: Toshiki Masuda, Osaka (JP); Kanehisa Kodan, Osaka (JP)

(73) Assignee: Minolta Co., Ltd., Osaka (JP)

( * ) Notice: Subject to any disclaimer, the term of this patent is extended or adjusted under 35 U.S.C. 154(b) by 54 days.

(21) Appl. No.: 10/132,150

(22) Filed: Apr. 26, 2002

(65) Prior Publication Data

US 2002/0159785 A1 Oct. 31, 2002

(30) Foreign Application Priority Data

Apr. 26, 2001 (JP) ..... 2001-129252

(51) Int. Cl.[7] ..... G03G 15/00

(52) U.S. Cl. ..... 399/45; 399/69; 399/384; 399/33

(58) Field of Search ..... 399/44, 45, 69, 399/70, 320, 322, 328, 335, 336, 384, 33, 400

(56) References Cited

U.S. PATENT DOCUMENTS 4,367,037 A * 1/1983 Nishikawa ..... 399/69
4,822,977 A * 4/1989 Leising et al. ..... 219/216
5,432,593 A * 7/1995 Nishikawa et al. ..... 399/328
5,568,241 A * 10/1996 Creutzmann et al. ..... 399/328
5,983,048 A * 11/1999 Moser ..... 399/67
6,049,680 A * 4/2000 Goris et al. ..... 399/44

FOREIGN PATENT DOCUMENTS

JP 57030867 A * 2/1982 ..... G03G/15/20
JP 58087573 A * 5/1983 ..... G03G/15/20
JP 59077473 A * 5/1984 ..... G03G/15/20
JP 01319081 A * 12/1989 ..... G03G/15/20
JP 04181250 A * 6/1992 ..... G03D/13/00
JP 08-220929 8/1996

* cited by examiner

*Primary Examiner*—Robert Beatty
(74) *Attorney, Agent, or Firm*—Morrison & Foerster LLP

(57) ABSTRACT

An image forming apparatus includes a transfer member for transferring a toner image to a recording medium, a first fusing unit, and a second fusing unit located upstream of the first fusing unit for preheating the recording medium to a prescribed temperature before fusing by the first fusing unit. A heating member heats the recording medium and a detector detects the temperature of the recording medium. A controller controls the output of the heating member and the second fusing unit based on the temperature of the recording medium. In addition, the a recording medium conveyance controller will move the recording medium forward and backward in the recording medium conveyance direction when the temperature of the recording medium detected by the temperature detector exceeds or reaches a prescribed temperature at the end of printing.

20 Claims, 4 Drawing Sheets

IMAGE FORMING APPARATUS HAVING A HEATING MEMBER TO HEAT THE RECORDING MEDIUM

The present application claims priority to Japanese Patent Application No. 2001-129252 filed Apr. 26, 2001, the entire content of which is hereby incorporated by reference.

BACKGROUND OF THE INVENTION

1. Field of the Invention

The present invention relates to an image forming apparatus that has a fusing device that thermally fixes a developer image onto a recording medium.

2. Description of the Related Art

In the conventional art, an invention pertaining to control of the fusing parameters of the fusing device based on the thickness, size, conveyance orientation, conveyance interval, temperature, etc. of the paper, is disclosed in Japanese Laid-Open Patent Application H8-220929.

However, according to the fusing device disclosed in the above patent application, because changes in water content that occur due to changes in the environment or differences in the paper material are not taken into consideration, the problem exists that the toner image on the paper cannot be completely fused due to the fact that the thermal characteristics (such as the specific heat and heat capacity) of the paper change when the water content thereof changes because the material of the paper varies even if the thickness stays the same or when the moisture in the environment changes.

SUMMARY OF THE INVENTION

A main object of the present invention is to maintain good fusing performance of the fusing device in a stable fashion at all times regardless of the environment or the material comprising the recording medium.

In order to resolve the problem identified above, the image forming apparatus pertaining to the present invention includes a transfer member that transfers the developer image onto the recording medium, a fusing member that thermally fuses the developer image transferred by the transfer member onto the recording medium, a heating member that heats the recording medium, a detecting member that detects the temperature of the recording medium after it is heated by the heating member, and a controller that controls the output of the heating member based on the result of the detection by the detecting member.

The fusing member may have a first fusing unit and a second fusing unit that is located upstream from the first fusing unit in terms of the recording medium conveyance direction and that preheats the recording medium to a prescribed temperature before fusing is performed by the first fusing unit, and the controller may control the output of the second fusing unit.

The first fusing unit may comprise a flash fusing device.

The second fusing unit may also function as the heating member, and the detecting member may be located between the first fusing unit and the second fusing unit.

A paper conveyance controller may be included that moves the recording medium positioned at the second fusing unit forward and backward in the conveyance path when the temperature detected by the detecting member reaches or exceeds a prescribed temperature at the end of printing.

The heating member and detecting member may be located upstream from the transfer member in terms of the recording medium conveyance direction.

The detecting member may also detect the temperature of the recording medium before it is heated by the heating member, and the controller may control the output of the heating member based on the difference in the temperature detected by the detecting member of the recording medium before and after heating by the heating member.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawings.

DETAILED DESCRIPTION OF THE PREFERRED EMBODIMENTS

The embodiments of the present invention are described below with reference to the accompanying drawings.

Figure 1:
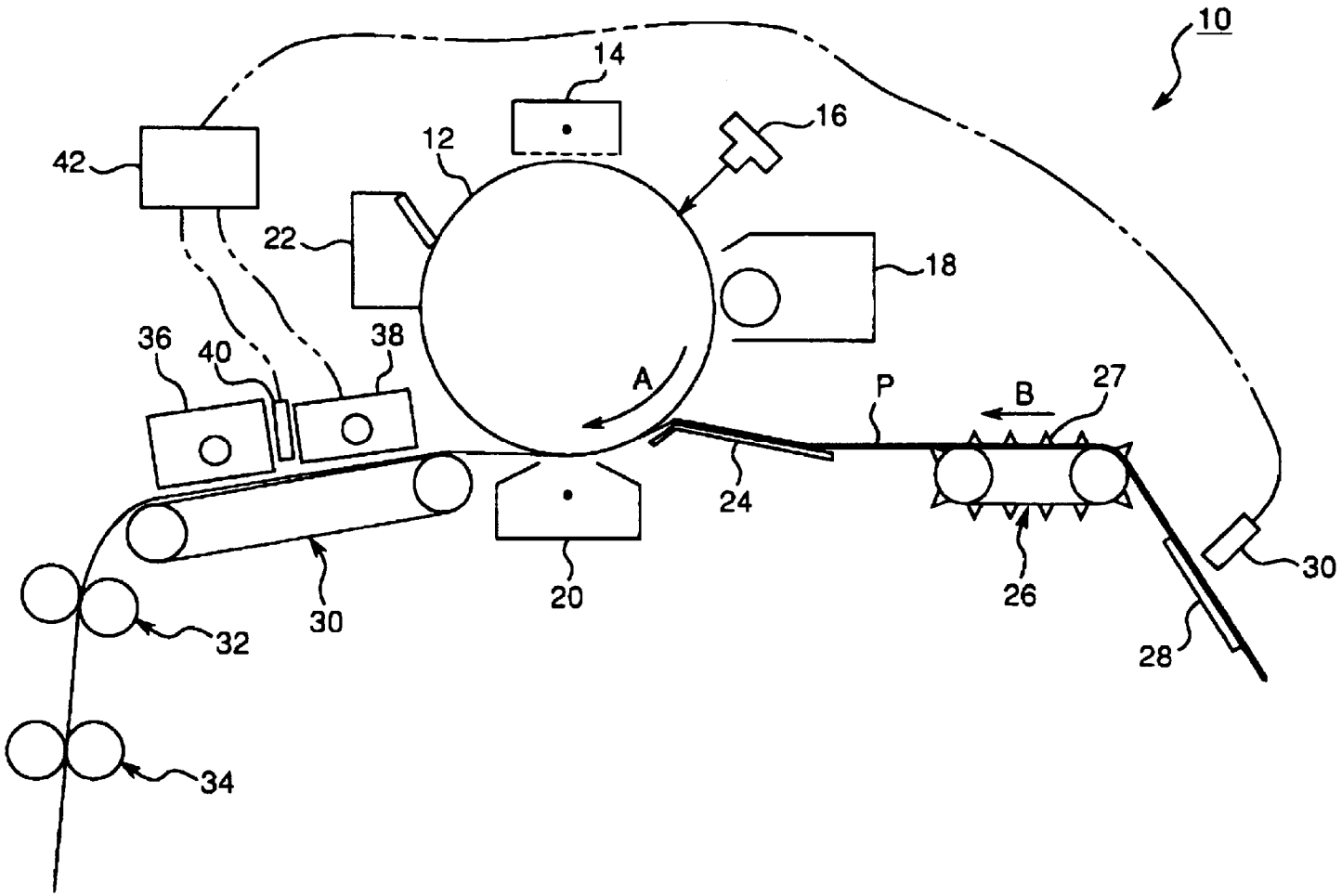
FIG. 1 is a drawing showing the basic construction of a continuous sheet printer comprising a first embodiment of the present invention.

FIG. 1 shows the basic construction of a continuous sheet printer 10 pertaining to a first embodiment of the present invention. This printer 10 includes a photoreceptor drum 12 that is driven to rotate in the direction of the arrow A. Located around this photoreceptor drum 12 are, in sequence along the direction of the rotation thereof, a charger 14 that uniformly charges the surface of the photoreceptor drum 12, an exposure device 16 that forms an electrostatic latent image by exposing the surface of the uniformly charged photoreceptor drum 12 in accordance with image signals, a developing system 18 that develops the electrostatic latent image into a toner image using toner (developer), a transfer device (transfer member) 20 that transfers the toner image onto the recording medium, and a cleaner 22 that collects the toner remaining on the surface of the photoreceptor drum 12 after the transfer.

In the printer 10, the continuous sheet P (recording medium) is conveyed from right to left in FIG. 1 such that it passes between the photoreceptor drum 12 and the transfer device 20. A paper guide 24 is located upstream from the transfer device 20 in terms of the continuous sheet P conveyance direction.

Upstream from the paper guide 24 in terms of the continuous sheet P conveyance direction is a tractor 26, which comprises paper conveyance means. The tractor 26 has multiple tractor pins 27 that are located at a prescribed pitch along the paper conveyance direction and are driven to move in the direction of the arrow B. The continuous sheet P is conveyed by these tractor pins 27 moving while engaged with the conveyance holes (not shown) formed at a prescribed pitch on either widthwise edge of the continuous sheet P.

A plate-like heater (heating member) 28 is located upstream from the tractor 26 in terms of the continuous sheet P conveyance direction. The continuous sheet P is heated at prescribed intervals by the heater 28, which is in contact with the rear side of the continuous sheet P. In addition, the temperature of the continuous sheet P before and after heating (or after heating) by the heater 28 is detected by a first paper temperature detecting sensor (detecting member) 30 located such that it faces the heater 28. The heater that comprises the heating member is not limited to a plate-like configuration or a contact type heater, but may comprise a heater having a different configuration or a non-contact heater (such as a heat lamp). Further, the heater 28 need not encompass the entire width of the continuous sheet P, but instead may correspond to a part of the continuous sheet P.

Downstream from the transfer device 20 in terms of the continuous sheet P conveyance direction are located, in the following order, a conveyance belt 30, a pair of intermediate rollers 32, and a pair of ejection rollers 34, each of which comprises paper conveyance means. The continuous sheet P that has passed the transfer area is conveyed downstream by the rotating conveyance belt 30 while adhering thereto due to suction, and is ejected via the nipping areas of the pair of intermediate rollers 32 and the pair of ejection rollers 34.

The fusing member is located above the conveyance belt 30 such that it faces the conveyance belt 30. The fusing member comprises an infrared heat lamp (preheating member) 38, which corresponds to a first fusing unit, and a flash fusing device 36, which corresponds to a second fusing unit. The infrared heat lamp (preheating member) 38 is located adjacent to and upstream from the flash fusing device 36 in terms of the continuous sheet P conveyance direction. A second paper temperature detecting sensor (detecting member) 40 is located between the flash fusing device 36 and the infrared heat lamp 38. The heater that comprises the preheating member is not limited to an infrared heat lamp, and may be a plate-like heater that heats the continuous sheet P from behind, for example. The first fusing unit is not limited to a flash-type fusing unit, and may comprise a fusing device in the form of a pair of rollers or a belt and a roller, for example.

The printer 10 also includes a controller 42. The controller 42 is electrically connected to the first paper temperature detecting sensor 30, infrared heat lamp 38 and second paper temperature detecting sensor 40, respectively.

The operation of the printer 10 having the construction described above will now be explained.

In the printer 10, continuous sheet P is first set in the manner shown in FIG. 1. When this is done, the top part of the continuous sheet P is placed on the paper guide 24, the tractor pins 27 are engaged in the conveyance holes of the paper P, and the heater 28 is in contact with the paper P. When the continuous sheet P is in this state, the temperature T0 of the continuous sheet P is first detected by the paper temperature detecting sensor 30 before heating by the heater 28, and is stored in memory by the controller 42. The continuous sheet P is then heated by the heater 28 for a prescribed period of time (such as 20 seconds), the temperature T1 of the heated continuous sheet P is detected by the paper temperature detecting sensor 30, and the temperature T1 information is transmitted to the controller 42. The thermal characteristics of the continuous sheet P are detected in this way not only when the paper is replaced (or set), but also when the power is turned ON, and when a certain period of time such as ten minutes or more has elapsed without printing, detection takes place every ten minutes, for example.

The controller 42 calculates the temperature difference (T1−T0) between the temperature before and after heating by the heater 28, determines the initial output or luminous efficiency of the infrared heat lamp 38 for printing based on the temperature difference, and controls the infrared heat lamp 38. The larger the temperature difference (T1−T0), the smaller the luminous efficiency of the infrared heat lamp 38, and the smaller the amount of heat that need be supplied to the continuous sheet P.

The table below shows an example of the lamp luminous efficiency that is suitable for preheating the continuous sheet P to a prescribed temperature (such as 60° C. to 80° C.) by the infrared heat lamp 38, and in no way comprises a limitation thereof. For example, It should be understood that the preheating member may comprise multiple infrared heat lamps that are aligned such that control can be performed to vary the number of infrared heat lamps that are aligned such that control can be performed to vary the number of infrared heat lamps that are caused to emit light, or where a plate-like heater is used for the preheating member, the voltage impressed thereto may be controlled.

After the luminous efficiency for the infrared heat lamp is determined in this way, the printer 10 begins a printing operation upon receiving image signals from an external device (such as a personal computer). In other words, the photoreceptor drum 12 is driven to rotate in the direction of the arrow A, and the surface thereof is uniformly charged by the charger 14. The surface of the uniformly charged photoreceptor drum 12 is then exposed by the exposure device 16 in accordance with the image signals, and an electrostatic latent image is formed. This electrostatic latent image is developed into a toner image by the developing system 18. This toner image is transferred by the transfer device 20 onto the continuous sheet P conveyed to the transfer area by the tractor 26. The toner remaining on the photoreceptor drum 12 after image transfer is collected by the cleaner 22. When continuous printing is performed, this electrophotographic process is repeated.

The continuous sheet P onto which the toner image has been transferred is conveyed while adhering to the upper belt of the conveyance belt 30 due to suction, and passes the area at which it faces the infrared heat lamp 38. When this occurs, the continuous sheet P is preheated before fusing to a prescribed temperature (such as 60° C. to 80° C.) by the infrared heat lamp 38, the luminous efficiency of which is controlled as described above. The toner image is then thermally fused onto the continuous sheet P by the flash fusing device 36. The continuous sheet P onto which the toner image has been fused is ejected via the pair of intermediate rollers 32 and the pair of ejection rollers 34.

During continuous printing, the temperature of the continuous sheet P is detected at all times by the second paper temperature detecting sensor 40 to monitor whether the continuous sheet P is preheated by the infrared heat lamp 38 to a prescribed temperature. Where the temperature deviates from the prescribed temperature, the controller 42 controls the luminous efficiency of the infrared heat lamp 38 such that the preheating temperature of the continuous sheet P equals the prescribed temperature.

As described above, in the continuous sheet printer 10 of this embodiment, by heating the continuous sheet P using the heater 28, detecting the temperature increase resulting from this heating using the paper temperature detecting sensor 30, and controlling the luminous efficiency of the infrared heat lamp 38 based on the result of the detection, the continuous sheet P can be preheated to a prescribed temperature by the infrared heat lamp 38 regardless of the environment or the material comprising the continuous sheet P. Therefore, using the printer 10 of this embodiment, good fusing performance of the flash fusing device 36 may be maintained at all times in a stable manner with regard to various types of continuous sheet P, including ticket paper and label sticker paper.

A continuous sheet printer 11 pertaining to a second embodiment of the present invention will now be explained with reference to FIG. 2.

The printer 11 of this embodiment differs from the printer 10 of the first embodiment only in that (i) it does not include a heater 28 or a first paper temperature detecting sensor 30, and (ii) the infrared heat lamp 38 operates as both a preheating member and a heating member. Because the construction of the printer 11 otherwise is the same as that of the printer 10, it will not be explained once more.

The operation of the printer 11 will now be explained.

Figure 2:
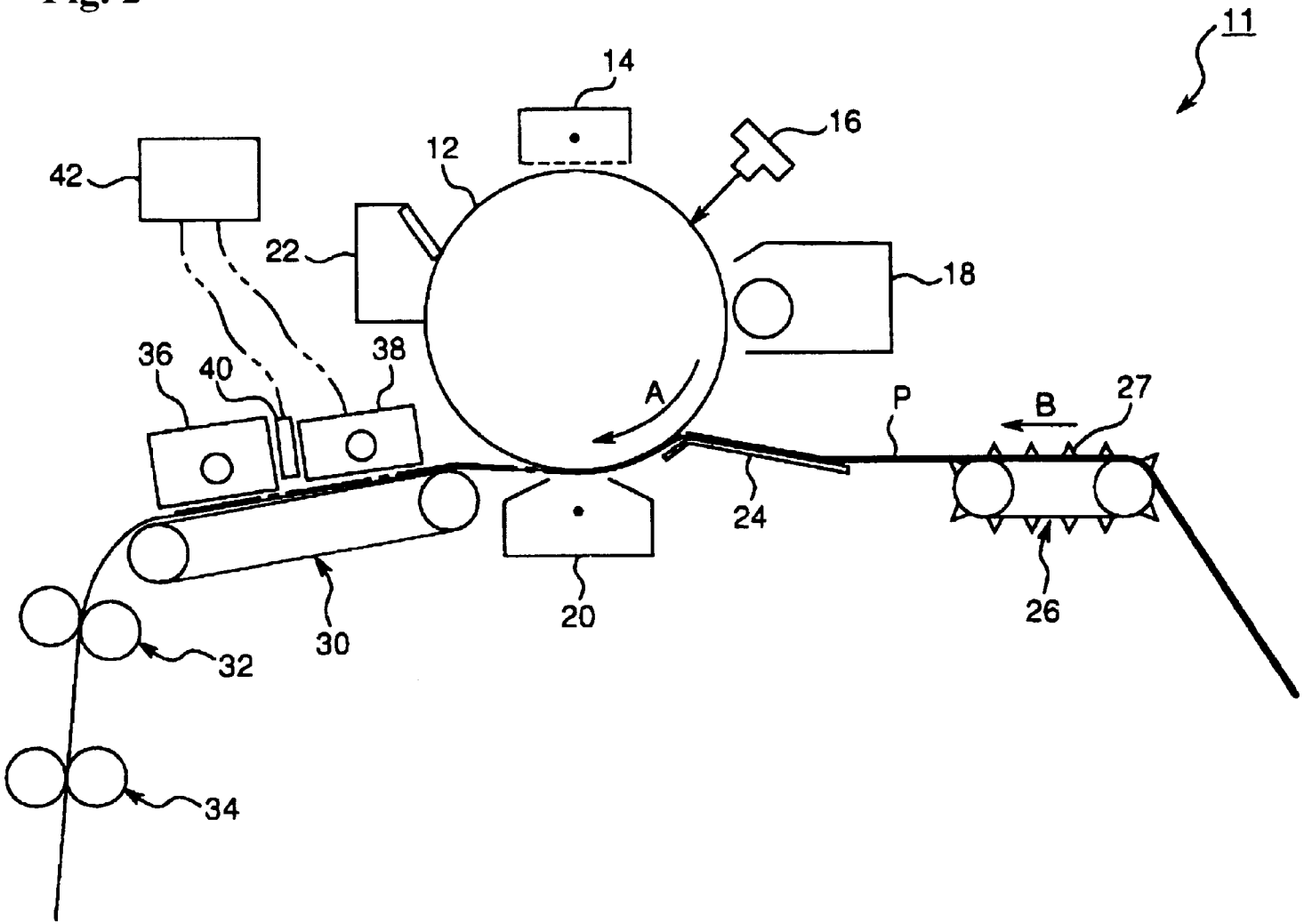
FIG. 2 is a drawing showing the basic construction of a continuous sheet printer comprising a second embodiment of the present invention.

In the printer 11, when continuous sheet P is set as shown by the solid line in FIG. 2, the infrared heat lamp 38 is first caused to emit light with a 50% luminous efficiency, and at the same time, the tractor 26 and conveyance belt 30 are driven to convey the continuous sheet P to the position shown by the dashed line. When this occurs, the temperature T2 of the top part of the continuous sheet P that was heated by the infrared heat lamp 38 is detected by the paper temperature detecting sensor 40, and the temperature T2 information is transmitted to the controller 42. The controller 42 stores in advance thermal characteristic data for various types of paper such as that one shown in FIG. 3, and determines the initial condition for the infrared heat lamp 38 from the thermal characteristic data based on the input paper temperature T2.

Figure 3:
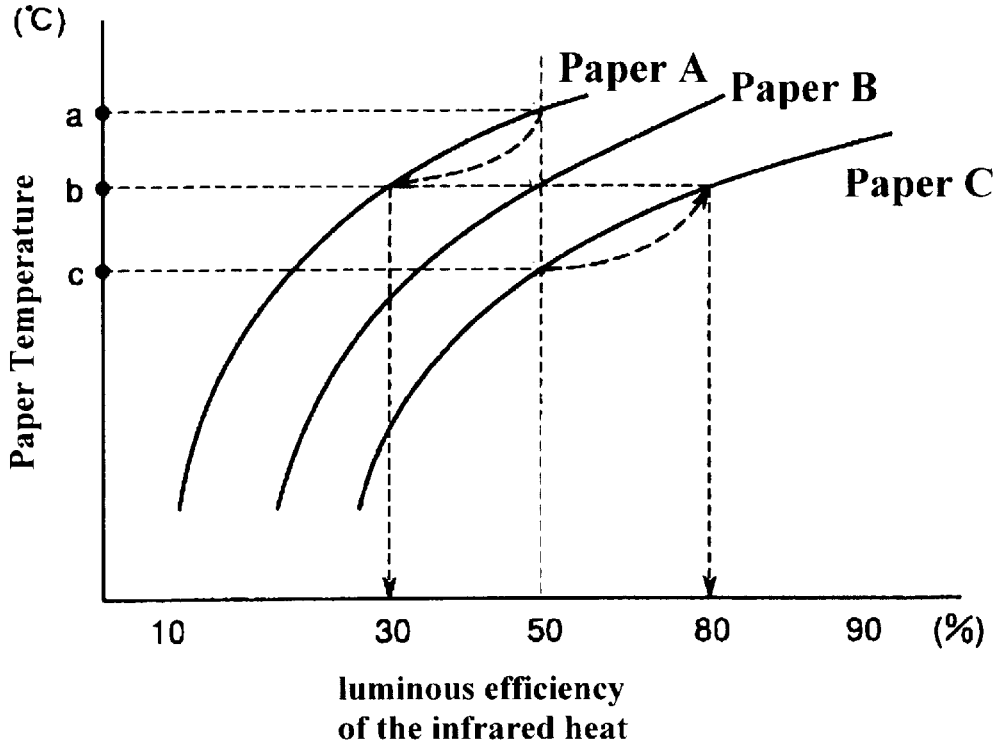
FIG. 3 is a graph showing thermal characteristic data for different types of paper.

Specifically, let us assume that the desired preheating temperature is a paper temperature (b) (such as 60° C. to 80° C.) in FIG. 3. As described above, where the detected paper temperature T2 is the temperature (a) when the infrared heat lamp 38 is caused to emit light with a 50% luminous efficiency, it is determined that paper type is type A. Because paper is type A, the luminous efficiency at which the preheating temperature becomes the desired paper temperature (b) is calculated from the approximate expression of the thermal characteristic data for paper A. As shown in FIG. 3, according to the thermal characteristic data for paper A, the paper temperature becomes (b) when the luminous efficiency of the infrared heat lamp 38 is 30%. Therefore, control is performed to change the initial condition of the infrared heat lamp 38 to 30% luminous efficiency. Alternatively, where the detected paper temperature T2 is the temperature (c), it is determined that the paper is type C. Because the paper is type C, the luminous efficiency at which the preheating temperature becomes the desired paper temperature (b) is calculated from the approximate expression of the thermal characteristic data for paper C. As shown in FIG. 3, according to the thermal characteristic data for paper C, the paper temperature becomes (b) when the luminous efficiency of the infrared heat lamp 38 is 80%. Therefore, control is performed to change the initial condition of the infrared heat lamp 38 to 80% luminous efficiency. If the detected paper temperature T2 is the temperature (b), it is determined that the type of paper is B. Because the type of paper is B, the luminous efficiency at which the preheating temperature becomes the desired temperature (b) is calculated from the approximate expression of the thermal characteristic data for paper B. As shown in FIG. 3, according to the thermal characteristic data for paper B, the paper temperature becomes (b) when the luminous efficiency of the infrared heat lamp 38 is 50%. Therefore, the initial condition of the infrared heat lamp 38 is left unchanged, with a luminous efficiency of 50%.

After determining the initial condition for the infrared heat lamp 38 in this way, the tractor 26 and conveyance belt 30 are driven in reverse such that the continuous sheet P is returned to the initial set position indicated by the solid line. The printer 11 stands by in this state until a print command is received. When a print command is received, the printer 11 performs an image forming operation via the electrophotographic process in the same manner as the printer 10.

As described above, in the printer 11 of the second embodiment, by forwarding the continuous sheet P for heating of the top part thereof using the infrared heat lamp 38, detecting the temperature increase resulting from this heating using the paper temperature detecting sensor 40, determining the luminous efficiency for the infrared heat lamp 38 based on the result of this detection and executing control, the continuous sheet P can be preheated to a prescribed temperature by the infrared heat lamp 38 regardless of the environment or the material comprising the continuous sheet P. Therefore, good fusing performance of the flash fusing device 36 can also be maintained at all times in a stable fashion by the printer 11 of this embodiment with regard to various types of continuous sheet P, including ticket paper and label sticker paper.

In the printer 11, the continuous sheet P was moved forward and then backward before printing in order to determine the initial luminous efficiency for the infrared heat lamp 38, but it is also acceptable if, where no problems are posed if no image is formed in the top 50 to 60 mm of the continuous sheet P, (i) temperature detection and luminous efficiency determination is performed as described above using the top 50 to 60 mm of the continuous sheet P, which will be heated by the infrared heat lamp 38 that initially emits light with a 50% luminous efficiency, and (ii) the luminous efficiency of the infrared heat lamp 38 is then controlled based on the result of the determination when printing is begun based on a print command.

Figure 4:
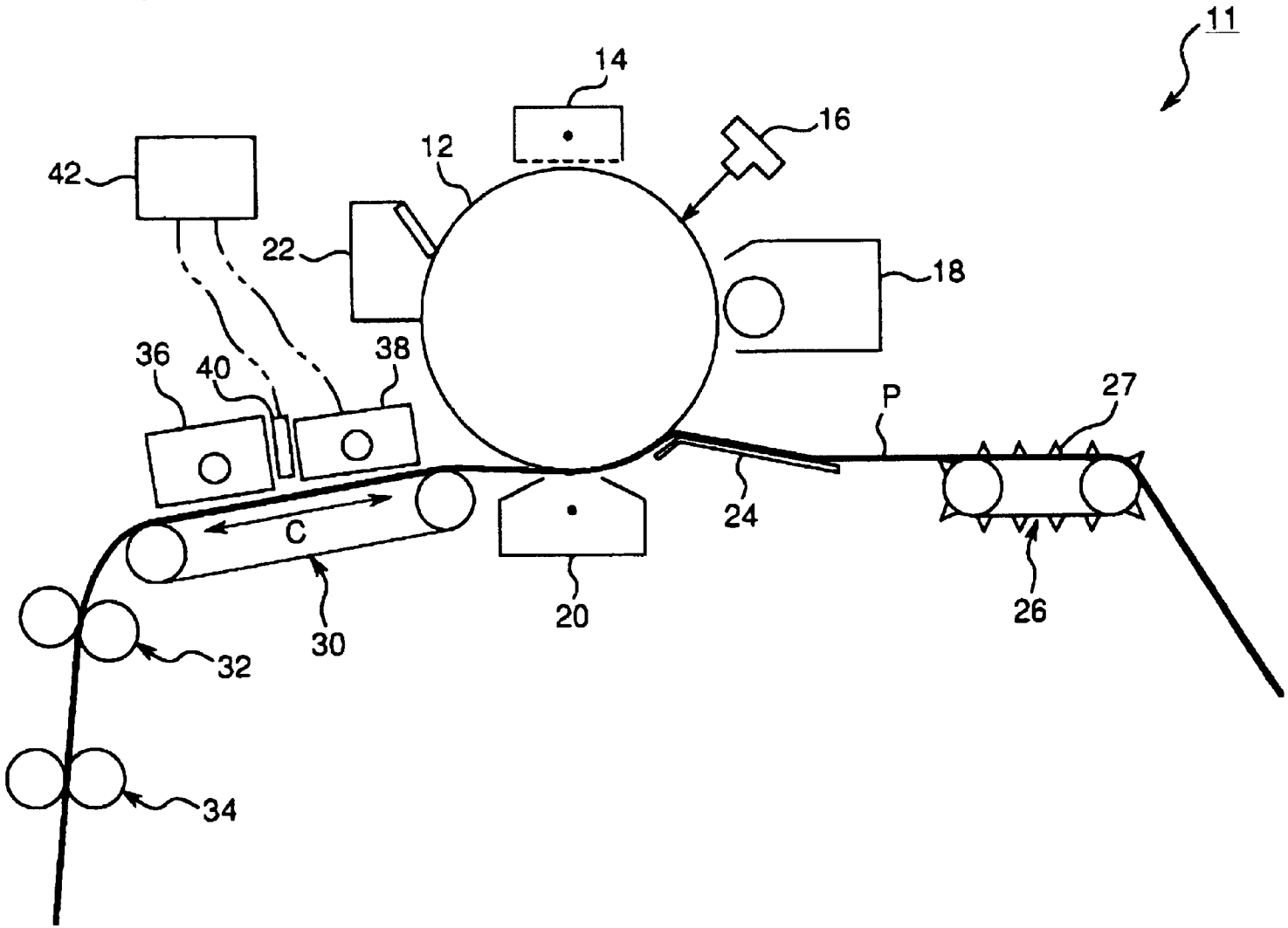
FIG. 4 is a drawing showing the situation in which the continuous sheet is moved forward and backward in the continuous sheet printer of the second embodiment.

Incidentally, where printing is completed in the printer 11, the continuous sheet P stops in the state shown in FIG. 4, such that the continuous sheet P also exists in the area where it faces the infrared heat lamp 38. Although the infrared heat lamp 38 is turned OFF simultaneously with the completion of printing, the problem occurs that the continuous sheet P becomes discolored a yellowish color if the temperature of the continuous sheet P rises to equal or exceed a prescribed temperature (such as approximately 100° C.) due to the residual heat from the infrared heat lamp 38 and the ambient temperature.

Therefore, the temperature of the continuous sheet P is detected using the paper temperature detecting sensor 40 after the completion of printing as well, and when this temperature increases to or above a certain temperature, the multiple paper conveyance means, i.e., the tractor 26, the conveyance belt 30, the pair of intermediate rollers 32 and the pair of ejection rollers 34, are reversed in a periodic fashion such that the continuous sheet P is moved forward and backward in the conveyance path (the directions shown by the two-headed arrow C) over a prescribed length (such as 100 mm) in the area in which the paper faces the infrared heat lamp 38. This prevents discoloration of the continuous sheet P in the area in which it faces the infrared heat lamp 38. When the temperature detected by the paper temperature detecting sensor 40 falls below a prescribed temperature, the forward and backward movement of the continuous sheet P is stopped.

It is also acceptable if the difference in the temperature of the continuous sheet P before and after heating by the infrared heat lamp 38 is calculated and the forward and backward movement of the continuous sheet P is stopped based on this temperature difference.

In each embodiment described above, an explanation was provided using a situation in which the present invention was applied in a continuous sheet printer, but the present invention may also be applied in a printer that performs printing onto separate individual sheets of paper.

The application of the present invention is not limited to printers. It may be applied in other types of image forming apparatuses, such as copying machines and facsimile machines.

As described above, using the image forming apparatus of the present invention, by heating the recording medium using a heating member, detecting using a detecting member the temperature increase resulting from this heating, and controlling the output of the fusing member based on the result of the detection, the recording medium can be heated to a prescribed temperature by the fusing member regardless of the environment or the material comprising the recording medium. Therefore, using the image forming apparatus of the present invention, good fusing performance of the fusing member can be maintained at all times in a stable fashion with regard to various types of recording media.

Although the present invention has been fully described by way of examples with reference to the accompanying drawings, it is to be noted that various changes and modifications will be apparent to those skilled in the art. Therefore, unless such changes and modification depart from the scope of the present invention, they should be construed as being included therein.

What is claimed is:

1. An image forming apparatus, comprising:

a transfer member which transfers developer image onto a recording medium;

a fusing member which thermally fuses the developer image transferred by the transferred member onto the recording medium;

a heating member which heats the recording medium;

a detecting member which detects a temperature of the recording medium after heating by the heating member; and a controller which controls output of the heating member based on the temperature of the recording medium detected by the detecting member, wherein the fusing member includes a first fusing unit and a second fusing unit located upstream from the first fusing unit in recording medium conveyance direction, the second fusing unit preheats the recording medium to a prescribed temperature before fusing by the first fusing unit, and the controller controls output of the second fusing unit.

2. The image forming apparatus of claim 1, wherein the first fusing unit includes a flash fusing device.

3. The image forming apparatus of claim 1, wherein the second fusing unit functions as the heating member; and the detecting member is located between the first fusing unit and the second fusing unit.

4. The image forming apparatus of claim 3, further comprising:

a paper conveyance controller which controls moving of the recording medium positioned at the second fusing unit, wherein the paper conveyance controller moves the recording medium forward and backward in the recording medium conveyance direction when the temperature of the recording medium detected by the detecting member reaches or exceeds a prescribed temperature at the end of printing.

5. The image forming apparatus of claim 1, wherein the heating member and the detecting member are located upstream from the transfer member in recording medium conveyance direction.

6. The image forming apparatus of claim 1, wherein the detecting member also detects a temperature of the recording medium before heating by the heating member, and the controller controls output of the heating member based on the difference the temperature of the recording medium before heating by the heating member and the temperature of the recording medium after heating by the heating member.

7. An image forming apparatus, comprising:

a transfer member which transfers developer image onto a recording medium;

a fusing member which thermally fuses the developer image transferred by the transferred member onto the recording medium and includes a first fusing unit and a second fusing unit located upstream from the first fusing unit in recording medium conveyance direction, the second fusing unit preheats the recording medium to a prescribed temperature before fusing by the first fusing unit;

a heating member which heats the recording medium;

a detecting member which detects a temperature of the recording medium after heating by the heating member; and a controller which controls output of the second fusing unit based on the temperature of the recording medium detected by the detecting member.

8. The image forming apparatus of claim 7, wherein the heating member and the detecting member are located upstream from the fusing member in a recording medium conveyance direction.

9. The image forming apparatus of claim 7, wherein the first fusing unit includes a flash fusing device.

10. An image forming apparatus, comprising:

a transfer member which transfers developer image onto a recording medium;

a fusing member which thermally fuses the developer image transferred by the transferred member onto the recording medium and includes a first fusing unit and a second fusing unit located upstream from the first fusing unit in recording medium conveyance direction, the second fusing unit preheats the recording medium to a prescribed temperature before fusing by the first fusing unit;

a detecting member which detects a temperature of the recording medium after heating by the second fusing unit; and a controller which controls output of the second fusing unit based on the temperature of the recording medium detected by the detecting member.

11. The image forming apparatus of claim 10, wherein the first fusing unit includes a flash fusing device.

12. The image forming apparatus of claim 10, wherein the detecting member is located between the first fusing unit and the second fusing unit.

13. An image forming method, comprising:

a heating step for heating a recording medium;

a detecting step for detecting a temperature of the recording medium after heating by the heating step;

a controlling step for controlling output of the heating step based on the temperature of the recording medium detected by the detecting step;

a transferring step for transferring developer image onto the recording medium;

a fusing step for thermally fusing the developer image transferred by the transferred step onto the recording medium; and a paper conveyance controlling step for controlling moving of the recording medium, wherein the paper conveyance controlling step moves the recording medium forward and backward in the recording medium conveyance direction when the temperature of the recording medium detected by the detecting step reaches or exceeds a prescribed temperature at the end of printing.

14. The image forming method of claim 13, wherein the detecting step also detects a temperature of the recording medium before heating by the heating step, and the controlling step controls output of the heating step based on the difference the temperature of the recording medium before heating by the heating step and the temperature of the recording medium after heating by the heating step.

15. An image forming apparatus, comprising:

a transfer member which transfers developer image onto a recording medium;

a fusing member which thermally fuses the developer image transferred by the transferred member onto the recording medium;

a heating member which is located upstream from the fusing member in recording medium conveyance direction and heats the recording medium;

a detecting member which detects a temperature of the recording medium after heating by the heating member; and a paper conveyance controller which controls moving of the recording medium positioned at the heating member, wherein the paper conveyance controller moves the recording medium forward and backward in the recording medium conveyance direction when the temperature of the recording medium detected by the detecting member reaches or exceeds a prescribed temperature at the end of printing.

16. The image forming apparatus of 15, wherein the fusing member includes a first fusing unit and a second fusing unit located upstream from the first fusing unit in recording medium conveyance direction; and the second fusing unit preheats the recording medium to a prescribed temperature before fusing by the first fusing unit.

17. The image forming apparatus of claim 16, wherein the first fusing unit includes a flush flash fusing device.

18. The image forming apparatus of claim 16, wherein the second fusing unit functions as the heating member; and the detecting member is located between the first fusing unit and the second fusing unit.

19. The image forming apparatus of claim 15, wherein the heating member and the detecting member are located upstream from the transfer member in recording medium conveyance direction.

20. The image forming apparatus claim 15, wherein the detecting member also detects a temperature of the recording medium before heating by the heating member, and the controller controls output of the heating member based on the difference the temperature of the recording medium before heating by the heating member and the temperature of the recording medium after heating by the heating member.

* * * * *